US009010403B2

(12) United States Patent
Zhu

(10) Patent No.: US 9,010,403 B2
(45) Date of Patent: Apr. 21, 2015

(54) NON-ELECTROSLAG REMELTING TYPE CLEAN METAL INGOT MOLD

(75) Inventor: Shucheng Zhu, Nanyang (CN)

(73) Assignee: Nanyang Xingzhi Patent Technology Service Co., Ltd. (CN)

( * ) Notice: Subject to any disclaimer, the term of this patent is extended or adjusted under 35 U.S.C. 154(b) by 17 days.

(21) Appl. No.: 13/876,886

(22) PCT Filed: Dec. 24, 2010

(86) PCT No.: PCT/CN2010/080241

§ 371 (c)(1),
(2), (4) Date: Apr. 24, 2013

(87) PCT Pub. No.: WO2012/040987

PCT Pub. Date: Apr. 5, 2012

(65) Prior Publication Data

US 2013/0299118 A1 Nov. 14, 2013

(30) Foreign Application Priority Data

Sep. 30, 2010 (CN) ..... 2010 1 0297876

(51) Int. Cl.
*B22C 9/00* (2006.01)
*B22C 9/06* (2006.01)
*B22D 7/06* (2006.01)

(52) U.S. Cl.
CPC ... *B22C 9/00* (2013.01); *B22D 7/06* (2013.01); *B22C 9/065* (2013.01)

(58) Field of Classification Search
CPC ..... B22C 9/00; B22C 9/06; B22C 9/065; B22D 7/06; B22D 7/08; B22D 7/064; B22D 27/04
USPC ..... 164/271, 322, 348
See application file for complete search history.

(56) References Cited

U.S. PATENT DOCUMENTS

| | | | | | |
|---|---|---|---|---|---|
| 3,899,017 | A * | 8/1975 | Croft | ..... | 164/497 |
| 4,759,399 | A * | 7/1988 | Saito et al. | ..... | 164/126 |
| 5,589,650 | A * | 12/1996 | Flemming et al. | ..... | 73/866 |
| 2003/0145977 | A1 * | 8/2003 | Smashey | ..... | 164/462 |

FOREIGN PATENT DOCUMENTS

| | | | |
|---|---|---|---|
| CN | 1241461 | A | 1/2000 |
| CN | 101406938 | A | 4/2009 |
| CN | 201223932 | Y | 4/2009 |
| CN | 101543877 | A | 9/2009 |
| JP | 60-177933 | A | 9/1985 |
| SU | 933195 | A2 | 6/1982 |

OTHER PUBLICATIONS

English Machine Translation of CN 101406938.*
International Search Report for PCT/CN2010/080241, mail date Jun. 30, 2011.

* cited by examiner

*Primary Examiner* — Kevin P Kerns
*Assistant Examiner* — Steven Ha
(74) *Attorney, Agent, or Firm* — Rossi, Kimms & McDowell LLP

(57) ABSTRACT

A non-electroslag remelting type clean metal ingot mold includes an ingot mold body and a insulating riser arranged on the ingot mold body; an insulated heating and heat preservation device is vertically arranged in the ingot mold body and divides the space in the ingot mold body into a plurality of independent cavity units; and the cavity units are distributed in two rows in the ingot mold body. Because the insulated heating and heat preservation device is arranged in the ingot mold body and divides the space in the ingot mold body into a plurality of independent cavity units, most of impurities and segregates in liquid metals are enriched in the part in contact with the isolation and heat insulation mechanism during the directional solidification and crystallization of the liquid metals and the enriched alloy segregates, and the impurities can be easily eliminated by utilizing flame or other processing methods.

22 Claims, 7 Drawing Sheets

NON-ELECTROSLAG REMELTING TYPE CLEAN METAL INGOT MOLD

This application is a U.S. National Phase Application of PCT International Application PCT/CN2010/080241, filed on Dec. 24, 2010, which is based on and claims priority from CN 201010297876.9, filed on Sep. 30, 2010, the contents of which is incorporated in its entirety by reference.

FIELD OF THE INVENTION

The present invention relates to a non-electroslag remelting type clean metal ingot mold which belongs to the field of metallurgical casting equipment technology.

BACKGROUND OF THE INVENTION

It is well known in the art that the conventional methods to get clean steel employ electroslag furnace remelting technology. The copper water-cooled crystallizer is filled with molten slag, in which inserted one end of the consumable electrode. The consumable electrode, slag pool, metal bath, steel ingot together with the bottom water tank form a loop through a short-net wire and transformer. During the power-on process, the Joule heat released from the slag pool gradually melt the end of the consumable electrode, and then the droplets converged from the molten metal pass through the slag pool and fall into the crystallizer to form a metal bath, which then rapidly solidifies into steel ingot after being cooled by water. During the forming of electrode tip droplets and droplets dripping through the slag pool, the steel fully contacts with the slag, and the non-metallic inclusion is absorbed by the slag.

The harmful elements in steel (e.g. sulfur, lead, antimony, bismuth, tin) was effectively removed through a reaction between steel and slag and a high-temperature gasification, but the remelting of ingot consumes a good deal of energy, and also restricts the large-scale industrial production. Moreover, the slag charge contains a lot of calcium fluoride which can pollute the environment. So, a de-dust and a de-fluorine device are have to be arranged. In addition, because the efficiency is particularly low, especially the electric arc could seriously damage the crystallizer, a crystallizer mold in the manner of electroslag furnace remelting can only refine scores of furnace of steel, which increases the cost of production. However, the ordinary ingot casting method can not achieve the effect of cleanliness.

SUMMARY OF THE INVENTION

The purpose of the present invention is to solve the above-mentioned drawbacks in the prior art. The present invention provides a non-electroslag remelting type clean metal ingot mold which can save energy, reduce pollutant emissions and improve production efficiency and utilization. By using this equipment, molten steel smelted by the converter, electric furnace, LF furnace or VD furnace can be poured directly into the device and then get a clean steel ingot. In this way, it can significantly reduce energy consumption, increase production efficiency and lower the production costs.

According to an embodiment of the present invention, a non-electroslag remelting clean metal ingot mold is provided, which is set on a platen and comprises the ingot mold body and the insulating riser installed on the ingot mold body. An insulated heating and heat preservation device is set vertically in the ingot mold body. The insulated heating and heat preservation device divides the space of ingot mold body into a plurality of separate mold cavity units. The cavity units are arranged in two rows in the ingot mold body.

The lower portion of the insulated heating and heat preservation device which distributes the cavity units in two rows is provided with a ridge integrated with the bottom mold plate of the ingot mold.

The lower portion of the insulated heating and heat preservation device is provided with a ridge integrated with the bottom mold plate of the ingot mold.

The ingot mold body is a water-cooled ingot mold.

The ingot mold body is an ordinary ingot mold.

The peripheral mold plate on the ingot mold body is moveably connected with the framework arranged outside the ingot mold body through a hydraulic mechanism or a screw rod-nut.

The insulated heating and heat preservation device is a high temperature resistant plate.

The insulated heating and heat preservation device comprises a high temperature resistant plate and a strong heating components inside the plate.

A casting system is disposed on the ingot mold body.

The casting system comprises a sprue outside the framework. The sprue is communicated with the runner inside the platen. The runner is communicated with a plurality of internal separate mold cavity units through several ingates respectively.

The casting system comprises a sprue outside the framework. The sprue is communicated with the runner inside the bottom mold plate. The runner is communicated with a plurality of internal separate mold cavity units through several ingates respectively.

A clamping groove is arranged on the inner wall of the ingot mold body and is used in conjunction with the insulated heating and heat preservation device. The two ends of the insulated heating and heat preservation device are disposed in the groove. An upper groove is provided on the inner wall of insulating riser, and the upper groove is clamped to the joint portion of the insulated heating and heat preservation device.

The present invention is a non-electroslag remelting type method. An insulated heating and heat preservation device is set in the ingot mold body set. The insulated heating and heat preservation device divide the space into a plurality of separate mold cavity units.

The mold cavity units in the ingot mold body are distributed in two rows. During the solidification and crystallization of liquid metal, each separate mold cavity unit has a solidification starting surface with rapid outward thermal conductivity, i.e. the surface in contact with the circumferential mold plate, and a solidification ending surface in contact with the insulated heating and heat preservation device. The liquid metal in contact with water-cooled mold plate or other mold plates solidifies rapidly, which slowly crystallized towards the insulated heating and heat preservation device, and then drive the inclusions and segregates in the liquid metal towards the uncrystallized direction during the crystallizing process. The portion close to the insulated heating and heat preservation device solidifies at latest because of being away from lower temperature. After the directional solidification in the liquid metal, most of the inclusions and segregations thereinto enrich at the portion that contacts the insulated heating and heat preservation device, which makes it very easy to use flame or other processing methods to remove the enriched alloyed segregates and inclusions, thus could transfer and remove the segregates and inclusions in the ingots, thereby realizing the purpose of ingot purification. Compared with existing electroslag remelting techniques, the present invention could achieve the purification inside the metal without secondary melting, which can then save large amount of energy. In the mean time, this avoids the damage of hydrogen white point to the ingot led caused by electroslag remelting, with production efficiency being significantly increased, and the cost being significantly decreased.

In the present invention, the lower portion of the insulated heating and heat preservation device is provided with a ridge integrated with the bottom mold plate of the ingot mold, which can move the V-shape impurity-containing region produced during the crystallization process of the liquid metal to the heat preservation dead head region, which can make the impurity more intensively deviate from the ingot center, make it easy for post-processing of impurities and thus achieve clean metal.

Strong heat generating component provided in said insulated heating and heat preservation device heats up just before the liquid metal being poured into the ingot mold, in order to avoid the heat of molten metal being absorbed. During the process of directional solidification of liquid metal, the presence of insulated heating and heat preservation device can ensure the portion contacted thereto at a high temperature state, and most of the inclusions and segregates within the liquid metal was more concentrated in the region in contact with insulated heating and heat preservation device after directional solidification of the liquid metal, making it easier to be handled.

The casting system communicating with the bottom of the ingot mold helps to control the flow rate of the liquid metal. A plurality of inner runner communicates with a plurality of internal separate units in the ingot mold body, such that the individual parts of the liquid metal rise to substantially horizontal height, so as to ensure the pressure balance between the liquid metal in the each cavity of ingot and the insulated heating and heat preservation device.

A clamping groove used together with insulated heating and heat preservation device is provided on the inner wall of insulating riser and on the inner wall of the water-cooled ingot mold.

On the one hand, it ensures the insulated heating and heat preservation device upright, on the other hand, the clamping of the upper clamping groove of the insulating riser with the inclined clamping groove of the isolation heating insulating device fixes the position of the insulated heating and heat preservation device in the process of liquid metal solidification. The gravity of insulating riser presses on the insulated heating and heat preservation device and prevent it from floating, so as to ensure the insulated heating and heat preservation device stable and reliable in the casting process, thereby ensuring the shape of ingot.

As required, the present invention can set multiple cavity units in two rows, and clean runners once in an ingot casting, and can achieve multi-block or even dozens of blocks of metal ingots clean crystallization, which greatly improves work efficiency and reduce production costs.

BRIEF DESCRIPTION OF THE DRAWINGS

In the following, the present invention will be further described in conjunction with the accompanying drawings.

DETAILED DESCRIPTION OF THE INVENTION

Embodiment 1

Figure 1:
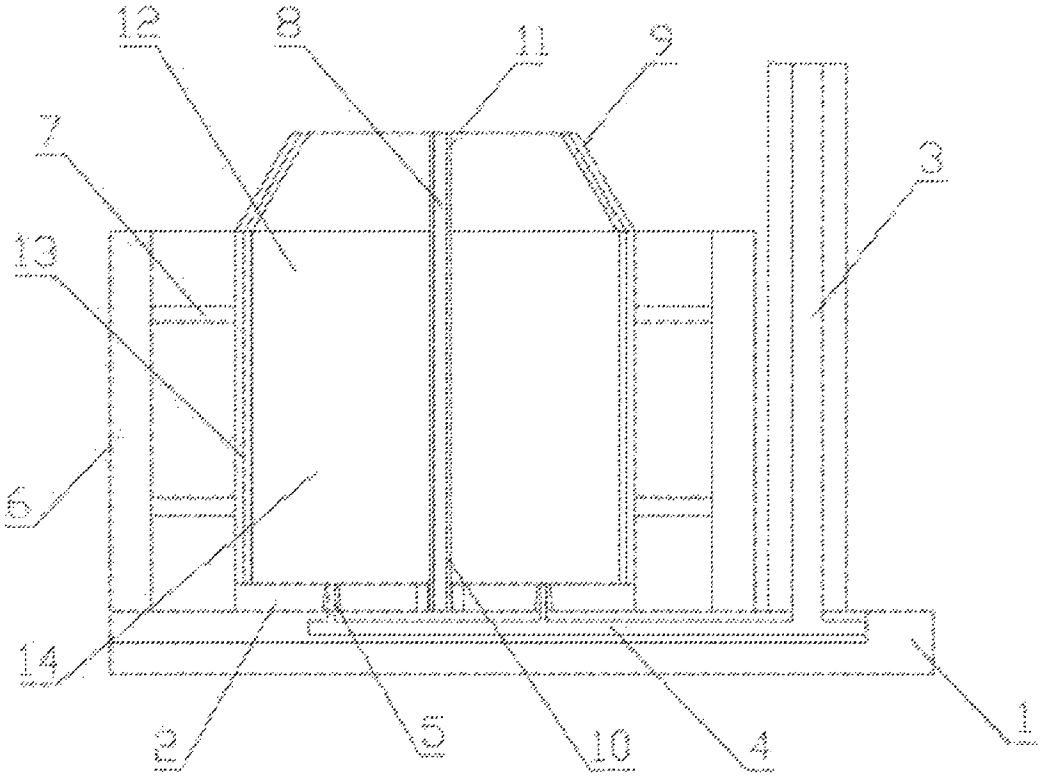
FIG. 1 is a schematic diagram according to a first embodiment of the present invention.
Figure 2:
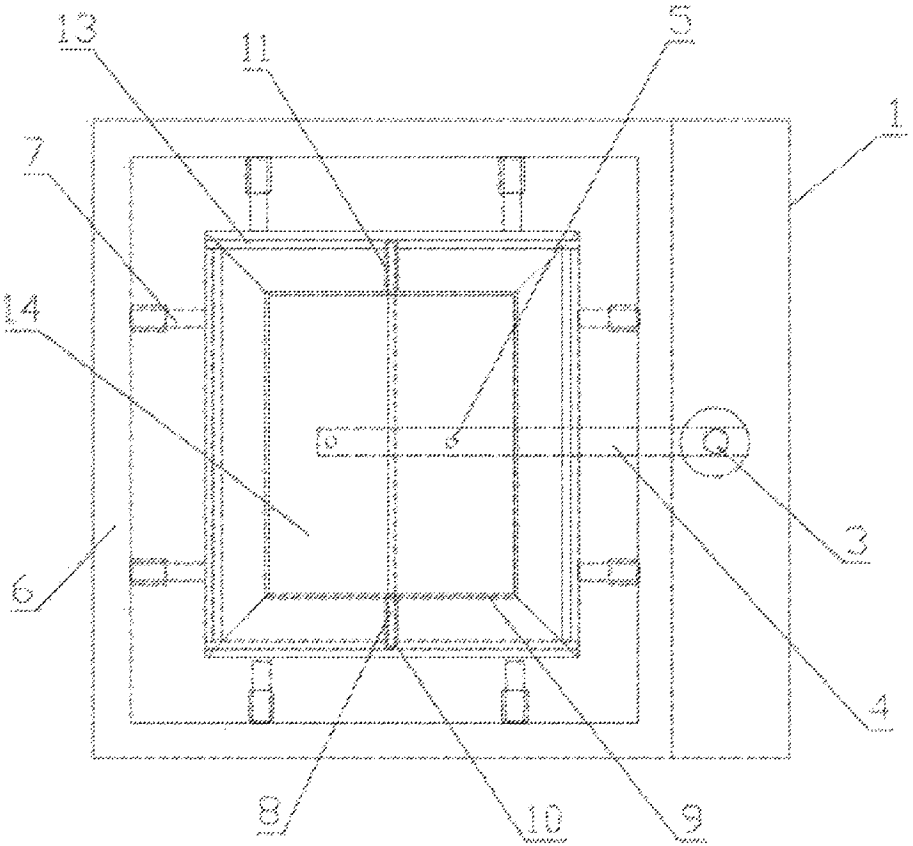
FIG. 2 is a plan view of FIG. 1.

As shown in FIGS. 1 and 2, a non-electro slag remelting clean metal ingot mold set on the platen 1, consists of ingot mold body 13 made up of common mold plate and the insulating riser 9 which is arranged on the ingot mold body 13. The ingot mold body 13 is provided with a casting system, and the insulated heating and heat preservation device 8 is provided vertically in the ingot mold body 13.

The insulated heating and heat preservation device 8 divides the ingot mold body 13 into two independent cavity units 14 which distribute into two rows in the ingot mold body 13.

The ingot mold body 13 is composed of four vertical mold plates and a bottom mold plate 2.

The vertical mold plate is moveably connected with the framework 6 arranged outside the ingot mold body 13 through a hydraulic mechanism 7 or a screw rod-nut.

The insulated heating and heat preservation device 8 is a high temperature resistant plate.

The casting system is connected with the bottom of the ingot mold body 13. The casting system comprises a sprue 3 outside the framework 6. The sprue 3 is communicated with the runner 4 set inside the platen 1. The runner 4 communicates with the 2 internal independent mold cavity units 14 through two ingates 5 respectively.

A clamping groove 10 is arranged on the inner wall of the ingot mold body 13 and is used in conjunction with the insulated heating and heat preservation device 8. The two ends of the insulated heating and heat preservation device 8 are disposed in the clamping groove 10. An upper groove 11 is provided on the inner wall of insulating riser 9, and the upper groove 11 is clamped to the joint portion of the insulated heating and heat preservation device.

Embodiment 2

Figure 3:
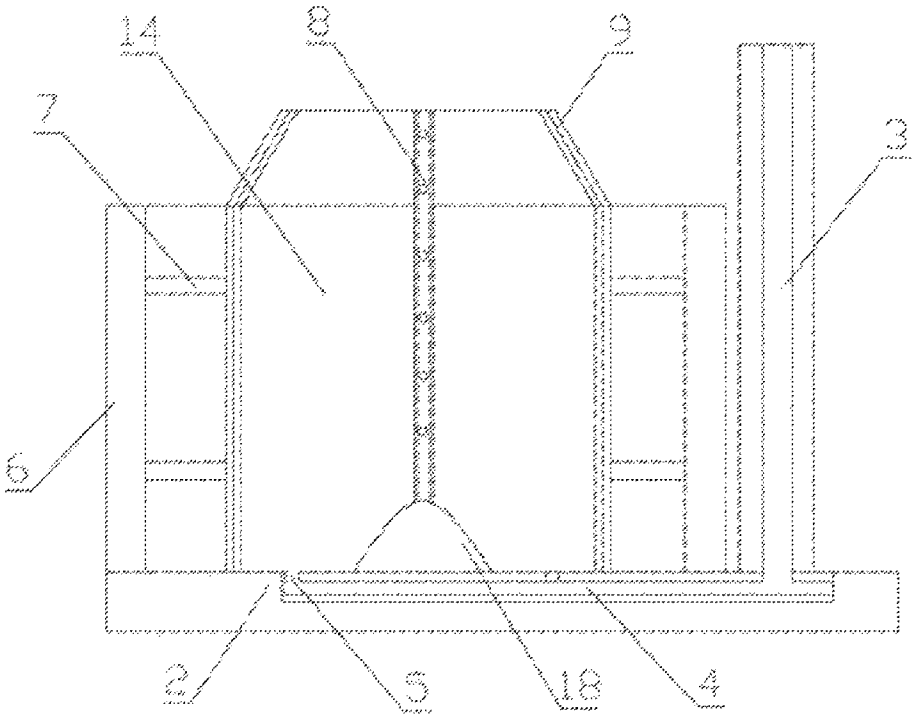
FIG. 3 is a schematic diagram according to a second embodiment of the present invention

As shown in FIG. 3, a non-electro slag remelting type clean metal ingot mold consists of the ingot mold body 13 which is composed by water-cooled mold plates and the insulating riser 9 disposed on the ingot mold body 13. The casting system is set on the ingot mold body 13. The insulated heating and heat preservation device 8 is vertically set in the ingot mold body 13. The insulated heating and heat preservation device 8 comprises high temperature resistant plate and strong heating components provided in the high temperature resistant plate, such as voltage heating member or gas-heating member.

The insulated heating and heat preservation device 8 divides the space of the ingot mold 13 into two separated cavity units 14. The cavity units 14 are distributed into two rows in the ingot mold body 13.

The ingot mold body 13 is composed of four vertical water-cooled mold plates and a water-cooled bottom mold plate 2.

The vertical water-cooled mold plates is moveably connected with the framework 6 arranged outside the ingot mold body 13 through a hydraulic mechanism 7 or screw rod-nut.

The ridge 18 on the bottom mold plate of the ingot mold is arranged on the lower part of the insulated heating and heat preservation device 8 which divides several cavity units into two rows.

The casting system is connected with the bottom of ingot mold body 13. The casting system comprises a sprue 3 set outside the framework 6. The sprue 3 is communicated with the runner 4 set inside the bottom mold plate 2. The runner 4 respectively communicates with the 2 internal independent mold cavity units 14 through two ingates 5.

A clamping groove 10 is arranged on the inner wall of the ingot mold body 13 and is used in conjunction with the insulated heating and heat preservation device 8. The two ends of the insulated heating and heat preservation device 8 are disposed in the clamping groove 10. An upper groove 11 is provided on the inner wall of insulating riser 9, and the upper groove 11 is clamped to the joint portion of the insulated heating and heat preservation device.

Embodiment 3

Figure 4:
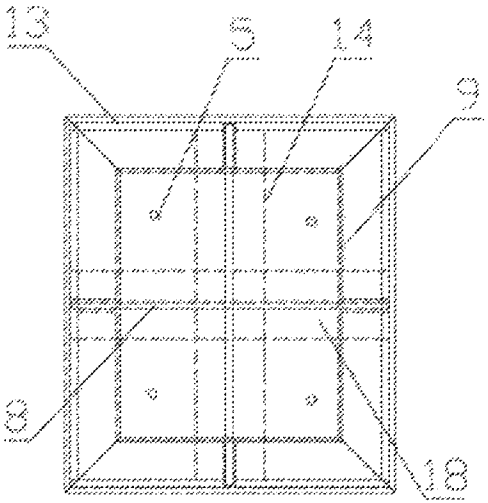
FIG. 4 is a schematic diagram of the portion of ingot mold body according to a third embodiment of the present invention.

As shown in FIG. 4, a non-electro slag remelting type clean metal ingot mold which is arranged on the platen 1, consists of the ingot mold body 13 which is composed by water-cooled mold plates and the insulating riser 9 disposed on the ingot mold body 13. The casting system is set on the ingot mold body 13. The insulated heating and heat preservation device 8 is vertically set in the ingot mold body 13. The insulated heating and heat preservation device 8 includes high temperature resistant plate and strong heating components provided in the high temperature resistant plate, such as voltage heating member or gas-heating member.

The horizontally and vertically crossed two insulated heating and heat preservation device 8 divides the space of the ingot mold 13 into four separated cavity units 14. The cavity units 14 are distributed into two rows in the ingot mold body 13.

The ingot mold body 13 is composed of four vertical water-cooled mold plates and a water-cooled bottom mold plate 2.

The vertical water-cooled mold plates is moveably connected with the framework 6 arranged outside the ingot mold body 13 by a hydraulic mechanism 7 or screw rod-nut.

The ridge 18 on the bottom mold plate of the ingot mold is arranged on the lower part of the insulated heating and heat preservation device 8 which divides several cavity units into two rows.

The casting system is connected with the bottom of ingot mold body 13, consisting of a sprue 3 set outside the framework 6. The sprue 3 is communicated with the runner 4 set inside the bottom mold plate 2. The runner 4 respectively communicates with the four internal independent mold cavity units 14 of the ingot mold body 13 through four ingates 5.

A clamping groove 10 is arranged on the inner wall of the ingot mold body 13 and is used in conjunction with the insulated heating and heat preservation device 8. The two ends of the insulated heating and heat preservation device 8 are disposed in the clamping groove 10. An upper groove 11 is provided on the inner wall of insulating riser 9, and the upper groove 11 is clamped to the joint portion of the insulated heating and heat preservation device.

Embodiment 4

Figure 5:
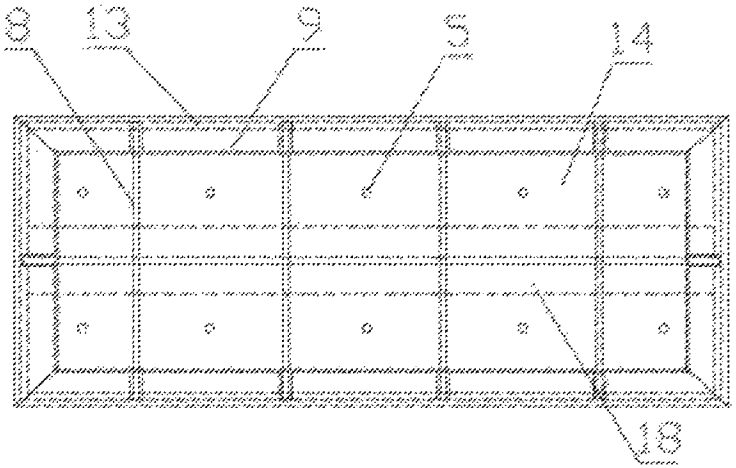
FIG. 5 is a schematic diagram of the portion of ingot mold body according to a forth embodiment of the present invention.

As shown in FIG. 5, a non-electro slag remelting type clean metal ingot mold which is arranged on the platen 1, consists of the ingot mold body 13 which is composed by water-cooled mold plates and the insulating riser 9 disposed on the ingot mold body 13. The casting system is set on the ingot mold body 13. The insulated heating and heat preservation device 8 is vertically set in the ingot mold body 13. The insulated heating and heat preservation device 8 comprises high temperature resistant plate and strong heating components provided in the high temperature resistant plate, such as voltage heating member or gas-heating member.

The two insulated heating and heat preservation devices 8 horizontally and four vertically crossed divide the space of the ingot mold 13 into four separated cavity units 14. The cavity units 14 are distributed into two rows in the ingot mold body 13.

The ingot mold body 13 is composed of four vertical water-cooled mold plates and a water-cooled bottom mold plate 2.

The vertical water-cooled mold plates is moveably connected with the framework 6 arranged outside the ingot mold body 13 by a hydraulic mechanism 7 or screw rod-nut.

The ridge 18 on the bottom mold plate of the ingot mold is arranged on the lower part of the insulated heating and heat preservation device 8 which divides several cavity units into two rows.

The casting system is connected with the bottom of ingot mold body 13, consisting of a sprue 3 set outside the framework. The sprue 3 is communicated with the runner 4 set inside the bottom mold plate 2. The runner 4 communicates with the ten internal independent mold cavity units 14 of the ingot mold body 13 through ten ingates 5 respectively.

A clamping groove 10 is arranged on the inner wall of the ingot mold body 13 and is used in conjunction with the insulated heating and heat preservation device 8. The two ends of the insulated heating and heat preservation device 8 are disposed in the clamping groove 10. An upper groove 11 is provided on the inner wall of insulating riser 9, and the upper groove 11 is clamped to the joint portion of the insulated heating and heat preservation device.

Embodiment 5

Figure 6:
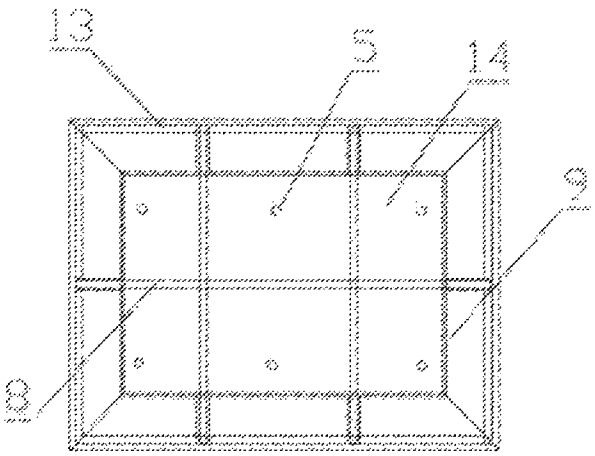
FIG. 6 is a schematic diagram of the portion of ingot mold body according to a fifth embodiment of the present invention.

As shown in FIG. 6, a non-electro slag remelting type clean metal ingot mold which is arranged on the platen 1, consists of the ingot mold body 13 which is composed by water-cooled mold plates and the insulating riser 9 disposed on the ingot mold body 13. The casting system is set on the ingot mold body 13. The insulated heating and heat preservation device 8 is vertically set in the ingot mold body 13. The one horizontal and two vertical insulated heating and heat preservation devices 8 crossed divide the space of the ingot mold 13 into six separated cavity units 14. The cavity units 14 are distributed into two rows in the ingot mold body 13.

The ingot mold body 13 is composed of vertical water-cooled mold plates and a water-cooled bottom mold plate 2.

The vertical water-cooled mold plates is moveably connected with the framework 6 arranged outside the ingot mold body 13 by a hydraulic mechanism 7 or screw rod-nut.

The ridge 18 on the bottom mold plate of the ingot mold is arranged on the lower part of the insulated heating and heat preservation device 8 which divides several cavity units into two rows.

The casting system is connected with the bottom of ingot mold body 13, consisting of a sprue 3 set outside the framework 6. The sprue 3 is communicated with the runner 4 set inside the bottom mold plate 2. The runner 4 communicates with the six internal independent mold cavity units 14 through six ingates 5 respectively.

A clamping groove 10 is arranged on the inner wall of the ingot mold body 13 and is used in conjunction with the insulated heating and heat preservation device 8. The two ends of the insulated heating and heat preservation device 8 are disposed in the clamping groove 10. An upper groove 11 is provided on the inner wall of insulating riser 9, and the upper groove 11 is clamped to the joint portion of the insulated heating and heat preservation device.

Figure 7:
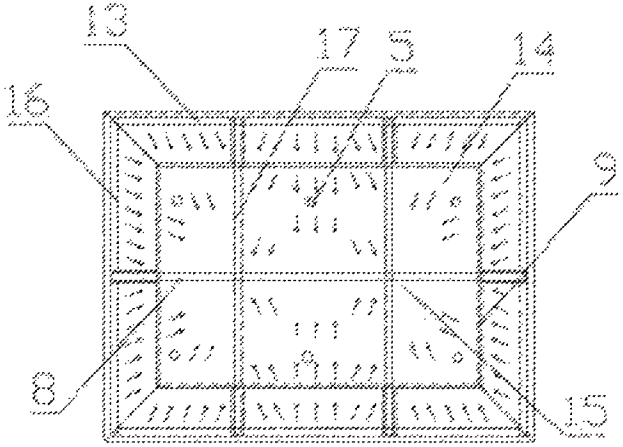
FIG. 7 is a schematic diagram of the oriented crystallization direction of liquid metal in the portion of ingot mold body part according to a fifth embodiment of the present invention.

As shown in FIG. 7, the water-cooled mold plate in the body of ingot mold 13 takes up a lot of heat, so as to ensure the rapid cooling of the liquid metal in the ingot mold. Each separate mold cavity unit 14 has a rapid outward thermal conductive solidification starting surface 16 and a solidification ending surface 17 in contact with the insulated heating and heat preservation device 8. The liquid metal contact with water-cooled mold plate and solidifies rapidly. And in the direction of the arrow in the figure, it slowly crystallizes towards the direction of the insulated heating and heat preservation device 8 from the solidification starting surface 16. During the process of crystallization, the inclusions and segregates will be driven to the direction of uncrystallized, and solidification ending surface close to the insulated heating and heat preservation device 8 solidifies at latest because of being away from the lower temperature. Within the liquid metal, most of the inclusions and segregates are enriched near the solidification ending surface 17 which contacts with the insulated heating and heat preservation device 8, becoming an enrichment part of inclusions and segregates 15. It will be very easy to use flame or other processing methods to remove the inclusions and segregates in the enrichment part of inclusions and segregates 15, so as to achieve the purpose of removing and transferring the inclusions and segregation in the ingot mold and getting purification ingot.

The scope of protection of the present invention is not limited to the above embodiments. As long as the ingot mold is provided with insulated heating and heat preservation device, which divides the inner space of the ingot mold body into multiple independent mold cavity units, and the cavity unites are arranged into two rows, all belongs within the scope of protection of the present invention. Further, the present invention is also not limited to the ordinary ingot mold, water-cooled ingot mold, but also applies to crystallizer ingot mold.

What is claimed:

1. A non-electroslag remelting type clean metal ingot mold, comprising an ingot mold body having a bottom mold plate and an insulating riser installed on the ingot mold body, wherein an insulated heating and heat preservation device is set vertically in the ingot mold body on a ridge such that the lower distal end of the insulated heating and heat preservation device is disposed above the uppermost surface of the bottom mold plate, the insulated heating and heat preservation device divides the space of ingot mold body into a plurality of separate mold cavity units, and the cavity units are arranged in two rows in the ingot mold body.

2. A non-electroslag remelting type clean metal ingot mold of claim 1, wherein the ridge is integrated with the bottom mold plate of the ingot mold.

3. A non-electroslag remelting type clean metal ingot mold of claim 1, wherein the ridge extends along the uppermost surface of the bottom mold plate in a first direction and in a second direction crossing the first direction.

4. A non-electroslag remelting type clean metal ingot mold of claim 1, wherein the ingot mold body is a water-cooled ingot mold.

5. A non-electroslag remelting type clean metal ingot mold of claim 1, wherein the ingot mold body is an ordinary ingot mold.

6. A non-electroslag remelting type clean metal ingot mold of claim 1, wherein a peripheral mold plate on the ingot mold body is moveably connected with a framework arranged outside the ingot mold body through a hydraulic mechanism or a screw rod-nut.

7. A non-electroslag remelting type clean metal ingot mold of claim 1, wherein the insulated heating and heat preservation device is a temperature resistant plate.

8. A non-electroslag remelting type clean metal ingot mold of claim 1, wherein the insulated heating and heat preservation device comprises a temperature resistant plate and a heating component inside the plate.

9. A non-electroslag remelting type clean metal ingot mold of claim 1, wherein a casting system is disposed on the ingot mold body.

10. A non-electroslag remelting type clean metal ingot mold of claim 1, wherein a clamping groove is arranged on the inner wall of the ingot mold body and is used in conjunction with the insulated heating and heat preservation device, the two ends of the insulated heating and heat preservation device are disposed in the groove, an upper groove is provided on the inner wall of insulating riser, and the upper groove is clamped to a joint portion of the insulated heating and heat preservation device.

11. A non-electroslag remelting type clean metal ingot mold of claim 2, wherein the ingot mold body is a water-cooled ingot mold.

12. A non-electroslag remelting type clean metal ingot mold of claim 3, wherein the ingot mold body is a water-cooled ingot mold.

13. A non-electroslag remelting type clean metal ingot mold of claim 2, wherein the ingot mold body is an ordinary ingot mold.

14. A non-electroslag remelting type clean metal ingot mold of claim 3, wherein the ingot mold body is an ordinary ingot mold.

15. A non-electroslag remelting type clean metal ingot mold of claim 2, wherein the insulated heating and heat preservation device is a temperature resistant plate.

16. A non-electroslag remelting type clean metal ingot mold of claim 2, wherein the insulated heating and heat preservation device comprises a temperature resistant plate and a heating component inside the plate.

17. A non-electroslag remelting type clean metal ingot mold of claim 2, wherein a casting system is disposed on the ingot mold body.

18. A non-electroslag remelting type clean metal ingot mold of claim 2, wherein a clamping groove is arranged on the inner wall of the ingot mold body and is used in conjunction with the insulated heating and heat preservation device, the two ends of the insulated heating and heat preservation device are disposed in the groove, an upper groove is provided on the inner wall of insulating riser, and the upper groove is clamped to a joint portion of the insulated heating and heat preservation device.

19. A non-electroslag remelting type clean metal ingot mold of claim 3, wherein the insulated heating and heat preservation device is a temperature resistant plate.

20. A non-electroslag remelting type clean metal ingot mold of claim 3, wherein the insulated heating and heat preservation device comprises a temperature resistant plate and a heating component inside the plate.

21. A non-electroslag remelting type clean metal ingot mold of claim 3, wherein a casting system is disposed on the ingot mold body.

22. A non-electroslag remelting type clean metal ingot mold of claim 3, wherein a clamping groove is arranged on the inner wall of the ingot mold body and is used in conjunction with the insulated heating and heat preservation device, the two ends of the insulated heating and heat preservation device are disposed in the groove, an upper groove is provided on the inner wall of insulating riser, and the upper groove is clamped to a joint portion of the insulated heating and heat preservation device.

* * * * *